US006378228B1

(12) United States Patent
Maziere

(10) Patent No.: US 6,378,228 B1
(45) Date of Patent: Apr. 30, 2002

(54) PROCESS TO MONITOR LINEN DRYING IN A DRIER

(75) Inventor: André Maziere, St. Pannes les Vaudes (FR)

(73) Assignee: Electrolux Systemes de Blanchisserie, Rosieres-Pres-Troyes (FR)

( * ) Notice: Subject to any disclaimer, the term of this patent is extended or adjusted under 35 U.S.C. 154(b) by 0 days.

(21) Appl. No.: 09/716,792

(22) Filed: Nov. 20, 2000

(30) Foreign Application Priority Data

Nov. 30, 1999 (FR) ..... 99 15063

(51) Int. Cl.[7] ..... F26B 3/00

(52) U.S. Cl. ..... 34/446; 34/315; 34/321; 34/322

(58) Field of Search ..... 34/315, 321, 322, 34/327, 446, 486, 527, 528, 534

(56) References Cited

U.S. PATENT DOCUMENTS

| | | | | | |
|---|---|---|---|---|---|
| 4,781,041 | A | * | 11/1988 | Fowler | 68/18 F |
| 5,737,852 | A | * | 4/1998 | Shukla et al. | 34/528 |
| 5,899,005 | A | * | 5/1999 | Chen et al. | 34/528 |
| 6,020,698 | A | * | 2/2000 | Stenger et al. | 318/162 |
| 6,047,486 | A | * | 4/2000 | Reck et al. | 34/491 |
| 6,098,310 | A | * | 8/2000 | Chen et al. | 34/475 |
| 6,199,300 | B1 | * | 3/2001 | Heater et al. | 34/446 |

* cited by examiner

*Primary Examiner*—Pamela Wilson
(74) *Attorney, Agent, or Firm*—Pearne & Gordon LLP

(57) ABSTRACT

To monitor the linen drying in a clothes drier, the residual moisture level of the linen inside the drier is measured and compared to a maximum permissible threshold, which is adjustable and authorization to open the door (14) of the drier is not allowed until the moisture level measured is below said threshold.

5 Claims, 1 Drawing Sheet

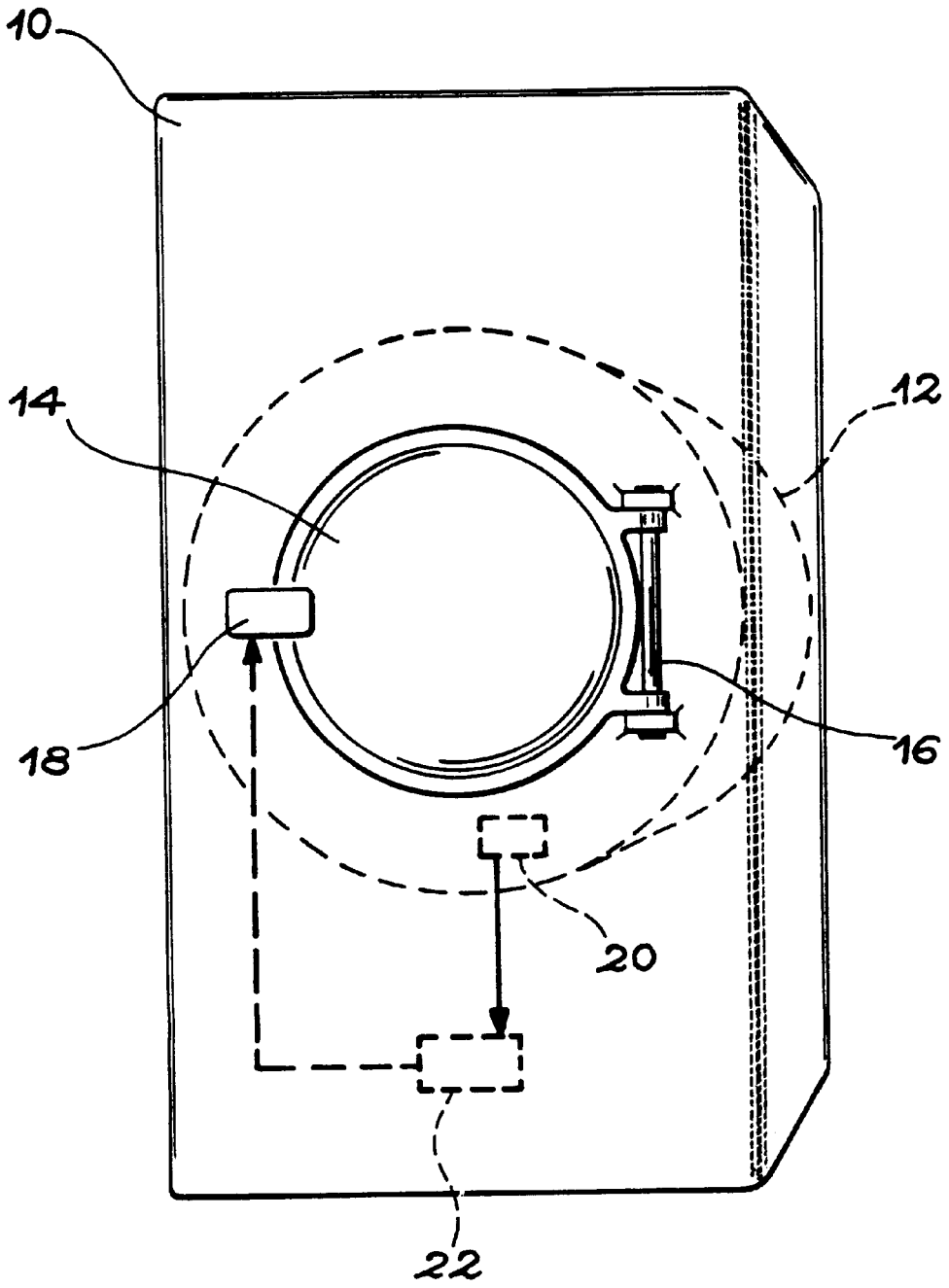
10
14
12
18
16
20
22

PROCESS TO MONITOR LINEN DRYING IN A DRIER

FIELD OF THE INVENTION

The invention relates to a process used to monitor the correct operation of a clothes drier, particularly the degree of drying of linen dried in said drier.

The invention applies to all types of clothes driers, wherein a load of previously washed linen is introduced wet and is taken out dry. It particularly relates to industrial and semi-industrial clothes driers, used particularly, but not exclusively, in laundries used to handle linen from hospitals.

STATE OF THE RELATED ART

In clothes driers, a load of linen is heated and turned for a generally adjustable period of time. A ventilation system is used to extract the water vapour released by the linen due to its heating from the drier. When the drying cycle set by the operator is complete, said operator opens the door of the drier and removes the load of linen that has just been dried.

Irrespective of the type of drier used, the dryness of the linen removed from the machine depends on the type of fabric, its moisture level when introduced into the machine, the heating temperature and processing time.

Generally, the heating temperature and the drier operating time are set manually by the operator, who makes these settings essentially as a function of the type of fabric and its moisture level when entering the drier. Therefore, the dryness of the linen removed from said drier totally depends on the operator's seriousness, skills and experience.

When the linen processed is obtained from hospitals, for example, the washed linen may still contain bacteria. These bacteria grow even more rapidly while the residual moisture level of the dried linen remains high. Therefore, it is strongly recommended to be able to maintain said moisture level at zero or at a value as close to zero as possible.

DESCRIPTION OF THE INVENTION

The invention specifically relates to a process devised to monitor the linen drying efficiency in a clothes drier precisely and reliably, particularly to be able to guarantee that the residual moisture level of the linen dried in said drier is zero or sufficiently low to prevent rapid growth of the bacteria potentially present in the linen.

According to the invention, this result is obtained by means of a process to monitor the aseptic nature of the linen, prior to the opening of at least one door of a clothes drier, characterised in that it consists of determining the residual moisture level of the linen inside the drier, comparing said level to a maximum permissible threshold and emitting a door opening authorisation signal when the residual moisture level is below the maximum permissible threshold.

According to a preferred embodiment of the invention, the residual moisture level of the linen is determined continuously.

In addition, when the drier comprises a metal drum and at least one agitating trough insulated electrically from said drum, the residual moisture level of the linen is determined advantageously by measuring the electrical resistivity between the trough and the drum.

The maximum permissible threshold is, preferentially, adjustable.

Whether adjustable or not, said threshold is advantageously equal to not more than 2%.

BRIEF DESCRIPTION OF FIGURES

As a non-limiting example, a preferred embodiment of the invention will now be described, referring to the appended drawing, wherein the single FIGURE is a perspective view illustrating very schematically a clothes drier wherein the monitoring process according to the invention is implemented.

DETAILED DESCRIPTION OF A PREFERRED EMBODIMENT OF THE INVENTION

In the single FIGURE, a clothes drier implementing the monitoring process according to the invention is represented very schematically. It should be noted that said monitoring process can be applied to any type of clothes drier, irrespective of the type of means used to dry the linen inside the machine.

The drier illustrated schematically in the single FIGURE comprises a parallelepiped casing 10 wherein a metal drum 12 is housed, capable of rotating around a horizontal axis. Control means (not shown) housed inside the casing 10 are capable of driving the drum 12 in rotation around its axis with or without reversal of direction.

The front panel of the casing 10 comprises a circular opening centred on the drum axis. This opening is normally sealed with a door 14 capable of pivoting around a vertical hinge 16. The door 14 is closed with a lock 18.

The opening of the door 14 makes it possible to access inside the drum 12, to introduce into said drum a load of linen to be dried or remove said load when the drying cycle is complete.

The clothes drier illustrated schematically in the single FIGURE also comprises heating means (not shown) which may be of any type (gas, electricity, steam or heating fluid).

In a specific embodiment, which is no way restrictive, one or more agitating troughs (not shown) are placed inside the drum 12 in order to increase the turning of the linen and improve the drying efficiency.

According to the invention, one or more moisture sensors 20 are placed inside the drum 12, so as to measure the residual moisture level present in the linen contained in the drier.

In practice, the moisture sensor 20 may be composed of a detector capable of measuring the electrical resistivity between the metal drum 12 and one of the agitating troughs (not shown) mounted inside said drum. This electrical resistivity detector may then comprise a strip conductor formed on an agitating trough insulated electrically with reference to the metal drum 12, and one or two carbon brushes mounted on the drum to rub against said strip conductor.

Other moisture sensors 20 such as infrared absorption detectors, sensors measuring the Ohmic resistance of the linen and its capacitance, etc. may also be used, without leaving the scope of the invention.

Advantageously, the residual moisture level determined by the sensor(s) 20 is measured continuously when the drier is in operation.

The signals emitted by the moisture sensor(s) 20 are transmitted to an electronic circuit 22, which makes a comparison between the residual moisture level measured by the sensor(s) and a maximum permissible threshold for the moisture level of the linen removed from the drier.

Advantageously, the electronic circuit 22 wherein the maximum permissible threshold is memorised for the residual moisture level of the linen removed from the machine is arranged such that said maximum permissible threshold is adjustable.

Whether adjustable or not, the maximum permissible threshold for the residual moisture level of the linen removed from the machine is preferentially equal to not more than 2%.

As long as the comparison made by the electronic circuit 22 shows that the residual moisture level of the linen in the drier is above the maximum permissible threshold, no signal is emitted and the lock 18 of the door 14 remains locked. Under these conditions, it is not possible to open the door 14 of the drier.

However, as soon as the comparison made by the electronic circuit 22 shows that the residual moisture level of the linen in the drier is below the maximum permissible threshold, an opening authorisation signal is emitted by said circuit and transmitted to the lock 18. The operator can then actuate said lock to open the door 14 and remove the linen load that has just been dried from the drier.

With the arrangement described above, the door 14 of the drier can only be opened when the residual moisture level of the linen contained in the drier is below a maximum permissible threshold. Consequently, it is possible to prevent the proliferation of bacteria in the linen removed from the drier.

It should be noted that different complementary arrangements are possible, without leaving the scope of the invention. In this way, it is possible to equip the drier with an indicator light or any comparable system capable of informing the operator that an opening authorisation signal has been emitted by the electronic circuit 12 or, on the contrary, that such a signal has not yet been emitted and that it is not possible to open the door.

In addition, in the case of a clothes drier equipped with several doors, none of the doors can be opened before the opening authorisation signal has been emitted.

I claim:

1. Process to monitor the aseptic nature of linen, prior to the opening of at least one door of a clothes drier, said process consisting of determining the residual moisture level of the linen inside the drier, comparing said level to a maximum permissible threshold and emitting a door opening authorisation signal when the residual moisture level is below the maximum permissible threshold.

2. Process according to claim 1, wherein the residual moisture level of the linen is determined continuously.

3. Process according to claim 1, wherein the residual moisture level of the linen is determined by measuring the electrical resistivity between an agitating trough and a drier drum.

4. Process according to claim 1, wherein the maximum permissible threshold is adjustable.

5. Process according to claim 1, wherein the maximum permissible threshold is equal to not more than 2%.

* * * * *

UNITED STATES PATENT AND TRADEMARK OFFICE

CERTIFICATE OF CORRECTION

PATENT NO. : 6,378,228 B1
DATED : April 30, 2002
INVENTOR(S) : Maziere

It is certified that error appears in the above-identified patent and that said Letters Patent is hereby corrected as shown below:

Title page,
Item [56], References Cited, please insert
-- FOREIGN PATENT DOCUMENTS

| | | |
|---|---|---|
| JP | 2-255199 | 10/1990 |
| GB | 2 217 824 | 11/1989 |
| EP | 0 039 645 | 11/1981 -- |

Signed and Sealed this

Twentieth Day of January, 2004

JON W. DUDAS
*Acting Director of the United States Patent and Trademark Office*